US008269703B2

(12) United States Patent
Park

(10) Patent No.: US 8,269,703 B2
(45) Date of Patent: Sep. 18, 2012

(54) ORGANIC LIGHT EMITTING DISPLAY DEVICE

(75) Inventor: Sung-Cheon Park, Yongin (KR)

(73) Assignee: Samsung Display Co., Ltd., Yongin (KR)

( * ) Notice: Subject to any disclaimer, the term of this patent is extended or adjusted under 35 U.S.C. 154(b) by 399 days.

(21) Appl. No.: 12/508,373

(22) Filed: Jul. 23, 2009

(65) Prior Publication Data

US 2010/0033409 A1 Feb. 11, 2010

(30) Foreign Application Priority Data

Aug. 6, 2008 (KR) ..... 10-2008-0076940

(51) Int. Cl.
*G09G 3/30* (2006.01)

(52) U.S. Cl. ..... 345/80; 345/206; 345/204; 345/76; 345/83; 315/169.3

(58) Field of Classification Search ..... 345/76–80, 345/82, 83, 204–206, 211–213; 315/169.3; 250/552, 553; 313/498, 506, 512
See application file for complete search history.

(56) References Cited

U.S. PATENT DOCUMENTS

| | | | | |
|---|---|---|---|---|
| 6,914,473 | B2 | 7/2005 | Hohenwarter | |
| 6,947,473 | B1 | 9/2005 | Rademacher | |
| 7,460,092 | B2 * | 12/2008 | Choi et al. | 345/76 |
| 7,583,131 | B2 * | 9/2009 | Kimura et al. | 327/534 |
| 7,907,108 | B2 * | 3/2011 | Chung | 345/98 |
| 8,138,997 | B2 * | 3/2012 | Kim | 345/76 |
| 2004/0160436 | A1 | 8/2004 | Tanaka | |
| 2005/0259051 | A1 | 11/2005 | Lee et al. | |
| 2006/0103322 | A1 | 5/2006 | Chung et al. | |
| 2006/0279260 | A1 | 12/2006 | Tsuge | |
| 2007/0024541 | A1 | 2/2007 | Ryu et al. | |
| 2008/0001894 | A1 | 1/2008 | Oh et al. | |

(Continued)

FOREIGN PATENT DOCUMENTS

DE 10 2006 058 816 A1 1/2008

(Continued)

OTHER PUBLICATIONS

European Search Report dated Aug. 25, 2010, for corresponding European Patent application 09167340.0.

(Continued)

*Primary Examiner* — Lun-Yi Lao
*Assistant Examiner* — Tom Sheng
(74) *Attorney, Agent, or Firm* — Christie, Parker & Hale, LLP

(57) ABSTRACT

An organic light emitting display device including a power generator for sending a plurality of voltages to a display unit. The display unit receives a scan signal, a light emitting control signal, and a data signal, which enable a current corresponding to the data signal to flow from a first power supply to a second power supply. The display unit includes a pixel circuit that includes a storage capacitor adapted to store the data signal and to stabilize the stored data signal utilizing a third power supply. A driver IC includes a signal generator for generating the data signal, the scan signal, and the light emitting control signal, and further includes a power generator for generating the first power, the second power, and the third power, wherein the second power and the third power are at a lower voltage than that of the first power.

13 Claims, 3 Drawing Sheets

U.S. PATENT DOCUMENTS

| | | | | |
|---|---|---|---|---|
| 2008/0111811 | A1 | 5/2008 | Park | |
| 2008/0143653 | A1* | 6/2008 | Shishido | 345/78 |
| 2008/0225022 | A1* | 9/2008 | Kim | 345/204 |
| 2009/0009496 | A1* | 1/2009 | Kwak et al. | 345/205 |

FOREIGN PATENT DOCUMENTS

| | | | |
|---|---|---|---|
| EP | 1 628 283 | A1 | 2/2006 |
| JP | 09-197366 | | 7/1997 |
| JP | 2002-268034 | | 9/2002 |
| JP | 2002-291232 | | 10/2002 |
| JP | 2005-165315 | | 6/2005 |
| JP | 2005-204411 | | 7/2005 |
| JP | 2005-275369 | | 10/2005 |
| JP | 2006-030318 | | 2/2006 |
| JP | 2006-065148 | | 3/2006 |
| JP | 2006-91089 | | 4/2006 |
| JP | 2007-093722 | | 4/2007 |
| JP | 2007-133369 | | 5/2007 |
| JP | 2008-040451 | | 2/2008 |
| JP | 2008-060189 | | 3/2008 |
| JP | 2008-111917 | | 5/2008 |
| JP | 2008-151963 | | 7/2008 |
| JP | 2008-176306 | | 7/2008 |
| KR | 10-2005-0095148 | | 9/2005 |
| KR | 10-2007-0083072 | A | 8/2007 |
| KR | 10-0805547 | B1 | 2/2008 |
| KR | 10-0809334 | B1 | 2/2008 |
| KR | 10-0833764 | B1 | 5/2008 |
| KR | 10-2008-0056098 | A | 6/2008 |

OTHER PUBLICATIONS

KIPO Office action dated Dec. 18, 2009, in priority Korean application No. 10-2008-0076940.

KIPO Office action dated Jun. 22, 2010, for priority Korean application No. 10-2008-0076940, as well as KR 10-2007-0083072 A, KR 10-0805547 B1, KR 10-0809334 B1, and KR 10-2008-0056098 A.

JP Office Action dated Jul. 5, 2011 issued in Japanese Patent Application No. 2009-002772, 4 pages.

European Patent Gazette dated Apr. 25, 2002, corresponding to European patent application 09167340.0 (3 pages).

* cited by examiner

ORGANIC LIGHT EMITTING DISPLAY DEVICE

CROSS-REFERENCE TO RELATED APPLICATIONS

This application claims priority to and the benefit of Korean Patent Application No. 10-2008-0076940, filed on Aug. 6, 2008, in the Korean Intellectual Property Office, the entire content of which is incorporated herein by reference.

BACKGROUND OF THE INVENTION

1. Field of the Invention

The present invention relates to an organic light emitting display device.

2. Description of Related Art

Recently, various flat panel display devices having less weight and volume than cathode ray tubes have been developed. As examples of flat panel display devices, there are liquid crystal display devices, field emission display devices, plasma display panels, organic light emitting display devices, etc.

Among flat panel display devices, organic light emitting display devices have various advantages such as excellent color reproducibility and a very thin profile. Accordingly, organic light emitting display devices have largely expanded their market into a variety of applications such as personal digital assistants (PDAs), MP3 players, and portable phones, to name but a few.

Organic light emitting display devices display images using organic light emitting diodes (OLEDs) that generate light by recombination of electrons and holes generated corresponding to a flow of current.

The organic light emitting diodes are positioned between a first power supply and a second power supply that has a lower voltage than the first power supply, and they control the current flowing between the first power supply and the second power supply by utilizing a data signal, thus emitting light corresponding to the amount of current flowing through the organic light emitting diode.

In an organic light emitting display device as described above, where the first power supply and the second power supply have poor voltage characteristics, the data signal fluctuates, causing the current flowing through the organic light emitting diode to fluctuate, thereby deteriorating picture quality.

SUMMARY OF THE INVENTION

An aspect of exemplary embodiments of the present invention provides a power generator that sends a plurality of voltages to a display unit in an organic light emitting display device. The power generator is adapted to reduce or prevent the fluctuation of data signals caused by varying the power supply voltage, thereby improving picture quality.

An organic light emitting display device according to a first aspect of the present invention includes a display unit for receiving a scan signal, a light emitting control signal, and a data signal, and enabling a current corresponding to the data signal to flow from a first power supply to a second power supply. The display unit includes a pixel including a switch and a first capacitor having a first terminal and a second terminal, the first terminal coupled to a control terminal of the switch, the first capacitor adapted to receive the data signal through the switch and store the data signal and to stabilize the stored data signal utilizing a third power supply; and a driver including a signal generator for generating the data signal, the scan signal, and the light emitting control signal, and further including a power generator for generating a first power of the first power supply, a second power of the second power supply, and a third power of the third power supply, the third power applied to a second terminal of the first capacitor, wherein the second power and the third power are at a lower voltage than that of the first power.

An organic light emitting display device according to a second aspect of the present invention includes a display unit for receiving a scan signal, a light emitting control signal, and a data signal, and enabling a current to flow from a first power supply to a second power supply, the current corresponding to the data signal, the display unit including a pixel including a switch and a first capacitor having a first terminal and a second terminal, the first terminal coupled to a control terminal of the switch, the first capacitor adapted to receive the data signal through the switch and store the data signal and to stabilize the stored data signal utilizing a third power supply; a driver for generating the data signal, the scan signal, and the light emitting control signal; and a power generator for generating a first power from the first power supply, a second power from the second power supply, and a third power from the third power supply, the third power applied to a second terminal of the first capacitor, wherein the second power and the third power are at a lower voltage than that of the first power.

An organic light emitting display device according to a third aspect of the present invention includes a display unit for receiving a scan signal, a light emitting control signal, and a data signal, and enabling a current to flow from a first power supply to a second power supply, the current corresponding to the data signal, the display unit including a pixel including a switch and a first capacitor having a first terminal and a second terminal, the first terminal coupled to a control terminal of the switch, the first capacitor adapted to receive the data signal through the switch and store the data signal and to stabilize the stored data signal utilizing a third power supply; a driver for generating the data signal, the scan signal, the light emitting control signal, and a third power from the third power supply, the third power applied to a second terminal of the first capacitor; and a power generator for generating a first power from the first power supply and a second power from the second power supply, wherein the second power and the third power are at lower a voltage than that of the first power.

With an organic light emitting display device according to various embodiments of the present invention, it is possible to vary the voltage sent to a cathode of the organic light emitting diode. Also, even when the voltage applied to the cathode is unstable, picture quality may not be deteriorated.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EMBODIMENTS

Figure 1:
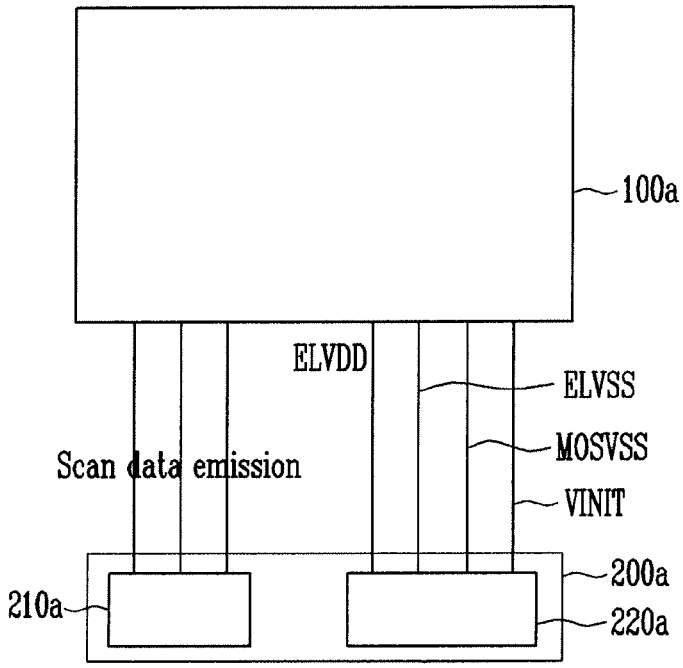
FIG. 1 is a block diagram of a first embodiment of an organic light emitting display device according to the present invention.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to the complete understanding of the invention are omitted for clarity. Also, like reference numerals refer to like elements throughout.

Hereinafter, embodiments of the present invention will be described with reference to the accompanying drawings.

FIG. 1 is a block diagram of an organic light emitting display device according to a first exemplary embodiment of the present invention. Referring to FIG. 1, the organic light emitting display device includes a display unit 100*a* and a driver integrated circuit (driver IC) 200*a*.

A plurality of pixels (not shown) are arranged in the display unit 100*a*, each of which includes an organic light emitting diode (not shown) that emits light corresponding to a flow of current. In the display unit 100*a* are arranged a plurality of scan lines (not shown) for sending scan signals (scan) in a row direction, a plurality light emitting control lines (not shown) for sending light emitting control signals (emission) in the row direction, and a plurality of data lines (not shown) for sending data signals (data) in a column direction.

Also, the display unit 100*a* is driven by receiving a first power ELVDD, a second power ELVSS, a third power MOSVSS, and an initialization voltage VINIT. Therefore, current flows through the organic light emitting diode in response to the scan signal (scan), the data signal (data), the first power ELVDD, the second power ELVSS, the third power MOSVSS, and the initialization voltage VINIT so that the display unit 100*a* emits light, thereby displaying an image.

The driver IC 200*a* sends the scan signal (scan), the data signal (data), the light emitting control signal (emission), the first power ELVDD, the second power ELVSS, the third power MOSVSS, and the initialization voltage VINIT to the display unit 100*a*. The driver IC 200*a* includes a signal generator 210*a* for generating the scan signal (scan), the light emitting control signal (emission), and the data signal (data), and a power generator 220*a* for generating the first power ELVDD, the second power ELVSS, the third power MOSVSS, and the initialization voltage VINIT. The data signal (data) is sent to a selected pixel selected by the scan signal (scan), and a current in accordance with the data signal (data) is generated in the pixel by the first power ELVDD, the second power ELVSS, the third power MOSVSS, and the initialization voltage VINIT, the current flowing through the organic light emitting diode depending on the state of the light emitting control signal (emission).

Figure 2:
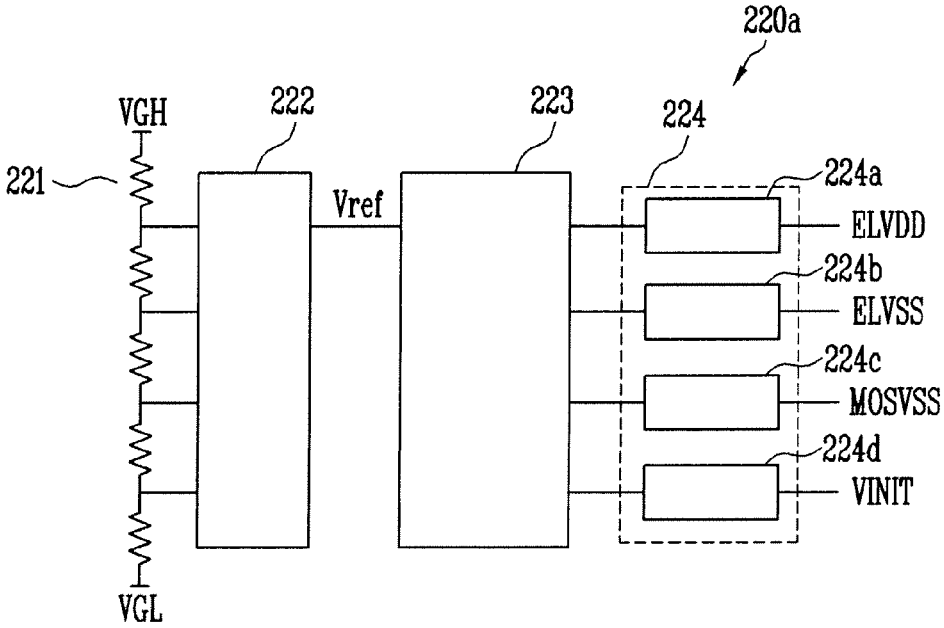
FIG. 2 is a block diagram of one embodiment of a power generator as shown in FIG. 1.

FIG. 2 is a block diagram of an exemplary embodiment of the power generator 220*a* shown in FIG. 1. Referring to FIG. 2, the power generator 220*a* includes a resistor row 221 (e.g., a voltage divider) including a plurality of resistors coupled between a high-state voltage VGH and a low-state voltage VGL, a selecting unit 222 for selecting a voltage (e.g., a predetermined voltage) from the resistor row 221 to generate a reference voltage Vref, a charge pump 223 for receiving the reference voltage Vref and increasing it or multiplying it by an integer, and a regulator 224 for receiving the voltage generated by the charge pump 223 and outputting a first power ELVDD from regulator 224*a*, a second power ELVSS from regulator 224*b*, a third power MOSVSS from regulator 224*c*, and an initialization voltage VINIT from regulator 224*d*.

The power generator 220*a* increases the reference voltage Vref selected by the selecting unit 222 (e.g., by multiplying Vref by an integer) utilizing the charge pump 223 to generate a plurality of voltages. The charge pump 223 may be a conventional circuit known to those skilled in the art, and the invention herein is not limited to any particular embodiment of a charge pump. The power generator 220*a* increases an absolute value of, and inverts, the reference voltage Vref to enable the voltage of the third power MOSVSS to be stably output by the regulator 224*c*.

Figure 3:
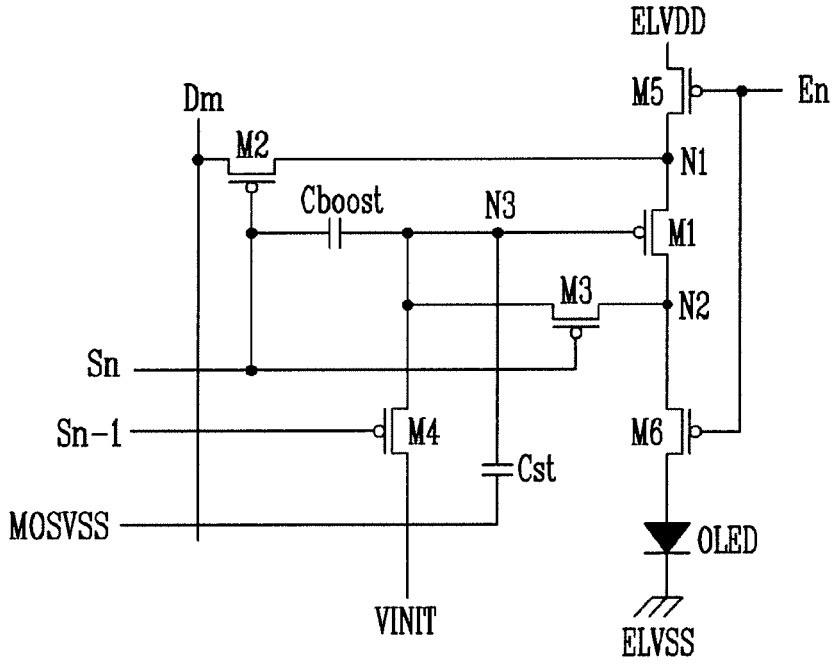
FIG. 3 is a schematic circuit diagram illustrating a pixel in a display unit as shown in FIG. 1.

FIG. 3 is a schematic circuit diagram illustrating an example of one of the pixels provided in the display unit shown in FIG. 1. Referring to FIG. 3, the pixel includes a first transistor M1, a second transistor M2, a third transistor M3, a fourth transistor M4, a fifth transistor M5, a sixth transistor M6, a first capacitor Cst, a second capacitor Cboost, and the organic light emitting diode OLED.

A source of the first transistor M1 is coupled to a first node N1, a drain thereof is coupled to a second node N2, and a gate thereof is coupled to a third node N3.

A source of the second transistor M2 is coupled to a data line Dm, a drain thereof is coupled to the first node N1, and a gate thereof is coupled to a first scan line Sn.

A source of the third transistor M3 is coupled to the second node N2, a drain thereof is coupled to the third node N3, and a gate thereof is coupled to the first scan line Sn.

A source of the fourth transistor M4 receives the initialization voltage VINIT, a drain thereof is coupled to the third node N3, and a gate thereof is coupled to a second scan line Sn-1.

A source of the fifth transistor M5 is coupled to a first power supply ELVDD, a drain thereof is coupled to the first node N1, and a gate thereof is coupled to a light emitting control line En.

A source of the sixth transistor M6 is coupled to the second node N2, a drain thereof is coupled to an anode electrode of the organic light emitting diode, and a gate thereof is coupled to the light emitting control line En.

A first electrode of the first capacitor Cst is coupled to the third node N3, and a second electrode thereof is coupled to a third power supply MOSVSS.

A first electrode of the second capacitor Cboost is coupled to the first scan line Sn, and a second electrode thereof is coupled to the third node N3.

The anode electrode of the organic light emitting diode OLED is coupled to the drain of the sixth transistor M6, and a cathode electrode thereof is coupled to a second power supply ELVSS.

Figure 4:
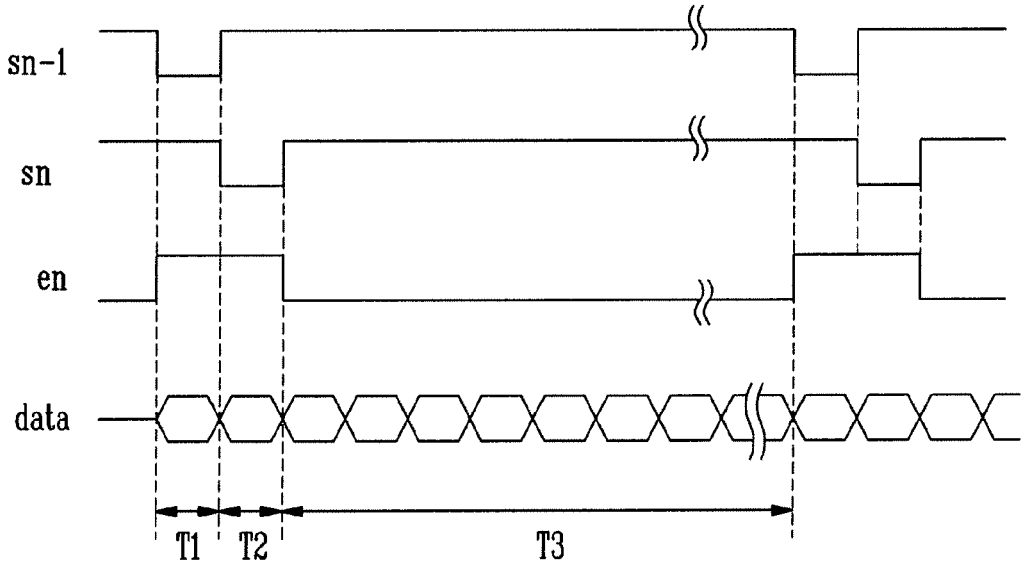
FIG. 4 is a timing diagram illustrating the operation of the pixel shown in FIG. 3.

FIG. 4 is a timing diagram illustrating operation of the pixel shown in FIG. 3. Referring to FIG. 4, a first scan signal sn is sent through the first scan line Sn, a second scan signal sn-1 is sent through the second scan line Sn-1, a data signal data is sent through the data line Dm, and a light emitting control signal en is sent through the light emitting control line En, to the pixel. Also, the initialization voltage VINIT is sent through an initialization line, and the first power ELVDD and the second power ELVSS, which enable the current to flow through the organic light emitting diode OLED, and the third power MOSVSS, which is utilized to stabilize a voltage of the first capacitor Cst, are sent to the pixel.

Herein, the second scan signal sn-1, which is a scan signal enabling the data signal (data) to be sent to a pixel in a previous line of pixels, enters a low voltage state before the first scan signal sn enters a low voltage state.

During operation, in a first period T1 during which the second scan signal sn-1 is in a low voltage state and the first scan signal sn and the light emitting control signal en are in a high voltage state, the fourth transistor M4 is in an on state so that the voltage of the third node N3 becomes substantially the same as the initialization voltage VINIT. At this time, because the fifth transistor M5 and the sixth transistor M6 are in an off state, current substantially does not flow through the organic light emitting diode OLED.

In a second period T2 during which the first scan signal sn is in a low voltage state and the second scan signal sn-1 and the light emitting control signal en are in a high voltage state, the second transistor M2 and the third transistor M3 are in an on state. When the third transistor M3 is in the on state, the voltage at the drain and the gate of the first transistor M1 becomes substantially equal and the first transistor is diode-connected. Therefore, a voltage corresponding to Equation 1 below is stored in the third node N3.

$$V_{N3}=V_{data}-|V_{th1}| \qquad \text{Equation 1}$$

Herein, $V_{N3}$ indicates the voltage of the third node N3, $V_{data}$ indicates the voltage of the data signal (data), and $V_{th1}$ indicates the threshold voltage of the first transistor M1.

In a third period T3 during which the first scan signal sn and the second scan signal sn-1 are in a high voltage state and the light emitting control signal en is in a low voltage state, because the voltage of the first scan signal sn rises from a low state to a high state, the voltage of the third node N3 coupled to the second capacitor Cboost also increases. Therefore, the voltage of the third node N3 substantially corresponds to Equation 2 below.

$$V_{N3}=V_{data}-V_{th1}|+\Delta V \qquad \text{Equation 2}$$

Herein, $V_{N3}$ indicates the voltage of the third node N3, $V_{data}$ indicates the voltage of the data signal (data), $V_{th1}$ indicates the threshold voltage of the first transistor M1, and ΔV indicates the rise in the voltage of the first scan signal sn.

Because the light emitting control signal en is in a low voltage state, current flows through the organic light emitting diode OLED, wherein the amount of the current flowing through the organic light emitting diode OLED substantially corresponds to Equation 3 below.

$$I_{OLED}=(V_{gs}-|V_{th1}|)^2=(ELVDD-(V_{data}-|V_{th1}|+\Delta V)-|V_{th1}|)^2=(ELVDD-V_{data}-\Delta V)^2 \qquad \text{Equation 3}$$

Herein, $V_{gs}$ indicates the voltage between the gate and the source of the first transistor M1, ELVDD indicates the voltage of the first power ELVDD, $V_{data}$ indicates the voltage of the data signal (data), $V_{th1}$ indicates the threshold voltage of the first transistor M1, and ΔV indicates the rise in the voltage of the first scan signal sn.

Therefore, the amount of current flowing through the organic light emitting diode OLED is substantially independent of the threshold voltage of the first transistor M1, thereby reducing or preventing an occurrence of brightness variation due to a variation of the threshold voltage of the first transistor M1. Also, in the case where the data signal (data) representing a "black" gray level is sent, which substantially does not generate a current through the organic light emitting diode OLED, the voltage of the third node N3 sent to the gate of the first transistor M1 is raised by the voltage of the first scan signal sn so that it is possible to more certainly prevent the current from flowing to the organic light emitting diode OLED. Thereby, the "black" gray level may be more precisely displayed.

In the pixel as described above, the third power MOSVSS is sent to the first electrode of the first capacitor Cst, and the second power ELVSS is sent to the cathode electrode of the organic light emitting diode OLED. The second power ELVSS may also be sent to the first electrode of the first capacitor Cst; however, if the voltage of the second power ELVSS fluctuates, the voltage of the third node N3 may fluctuate by a coupling phenomenon through the first capacitor Cst, although the same data signal (data) is sent. When the voltage of the third node N3 fluctuates, the amount of the current flowing from the first power supply ELVDD to the second power supply ELVSS varies so that picture quality substantially deteriorates.

Also, in order to reduce power consumption, the voltage of the second power ELVSS may be varied according to the surrounding environment. In this case, when the voltage of the second power ELVSS fluctuates, it is undesirable to send the second power ELVSS to the first capacitor Cst. To address this issue, in various embodiments of the present invention, the third power MOSVSS, instead of the second power ELVSS, is generated to be sent to the first capacitor Cst.

Figure 5:
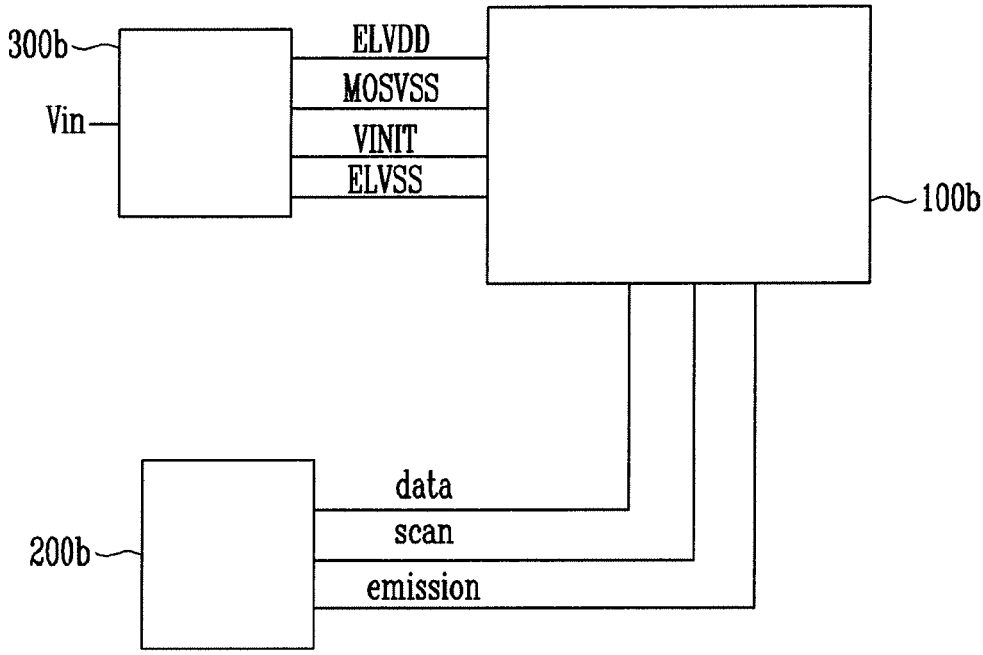
FIG. 5 is a block diagram of a second embodiment of an organic light emitting display device according to the present invention.

FIG. 5 is a block diagram illustrating an organic light emitting display device according to a second exemplary embodiment of the present invention. Referring to FIG. 5, the organic light emitting display device includes a display unit 100*b*, a driver IC 200*b*, and a power supply unit 300*b*.

A plurality of pixels (not shown) are arranged in the display unit 100*b*, each of which includes an organic light emitting diode (not shown) that emits light corresponding to a flow of current. In the display unit 100*b* are arranged a plurality of scan lines (not shown) for sending scan signals (scan) in a row direction, a plurality light emitting control lines (not shown) for sending light emitting control signals (emission) in the row direction, and a plurality of data lines (not shown) for sending data signals (data) in a column direction.

Also, the display unit 100*b* is driven by receiving a first power ELVDD, a second power ELVSS, a third power MOSVSS, and an initialization voltage VINIT. Therefore, current flows through the organic light emitting diode in response to the scan signal, the data signal, the first power ELVDD, the second power ELVSS, the third power MOSVSS, and the initialization voltage VINIT so that the display unit 100*b* emits light, thereby displaying an image.

The driver IC 200*b* sends the scan signal (scan), the light emitting control signal (emission), and the data signal (data). The data signal (data) is sent to a selected pixel selected by the scan signal (scan) sent from the driver IC 200*b*, and a current in accordance with the data signal (data) is generated in the pixel by the first power ELVDD, the second power ELVSS, the third power MOSVSS, and the initialization voltage VINIT, and flows through the organic light emitting diode depending on the state of the light emitting control signal (emission).

The power supply unit 300*b* generates the first power ELVDD, the second power ELVSS, the third power MOSVSS, and the initialization voltage VINIT to send to the display unit 100*b*. The power supply unit 300*b* boosts an input voltage Vin to generate the first power ELVDD and inverts the input voltage Vin to generate the second power ELVSS. The third power MOSVSS is generated by inverting and boosting an input voltage Vin using a charge pump, a regulator, and/or any other suitable circuit or device known to those skilled in the art. To this end, the power supply unit 300*b* includes a booster amplifying the input voltage to generate the first power ELVDD, an inverter inverting the input voltage to generate the second power ELVSS, and the charge pump inverting and then amplifying the input voltage to generate the third power MOSVSS.

Figure 6:
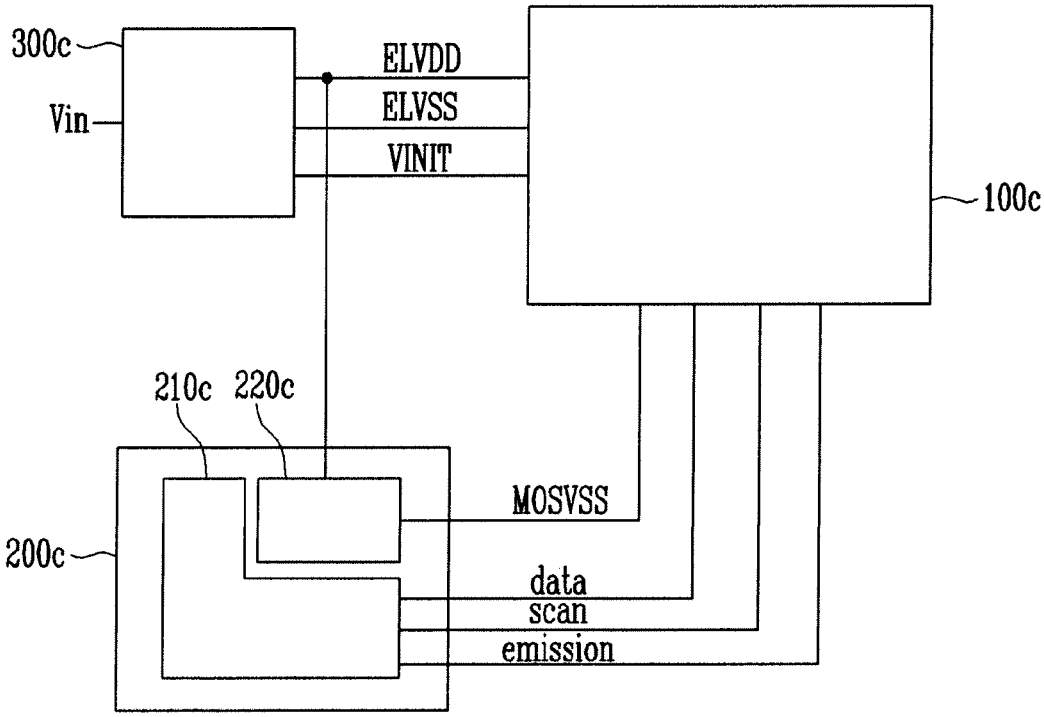
FIG. 6 is a block diagram of a third embodiment of an organic light emitting display device according to the present invention.

FIG. 6 is a block diagram illustrating an organic light emitting display device according to a third exemplary embodiment of the present invention. Referring to FIG. 6, the organic light emitting display device includes a display unit 100*c*, a driver IC 200*c*, and a power supply unit 300*c*.

A plurality of pixels (not shown) are arranged in the display unit 100*c*, each of which includes an organic light emitting diode (not shown) that emits light corresponding to a flow of current. In the display unit 100*c* are arranged a plurality of scan lines (not shown) for sending scan signals (scan) in a row direction, a plurality light emitting control lines (not shown) for sending light emitting control signals (emission) in the row direction, and a plurality of data lines (not shown) for sending data signals (data) in a column direction.

Also, the display unit 100*c* is driven by receiving a first power ELVDD, a second power ELVSS, a third power MOSVSS, and an initialization voltage VINIT. Therefore, in the display unit 100*c*, the data signal (data) is sent to a pixel by the scan signal (scan), and a current in accordance with the data signal (data) is generated in the pixel by the first power ELVDD, the second power ELVSS, the third power MOSVSS, and the initialization voltage VINIT, and flows through the organic light emitting diode depending on the state of the light emitting control signal (emission).

The driver IC 200*c* includes a signal generator 210*c* and a power generator 220*c*. The signal generator 210*c* generates the scan signal (scan), the light emitting control signal (emission), and the data signal (data). The power generator 220*c* generates the third power MOSVSS. The data signal (data) is sent to a selected pixel selected by the scan signal (scan) generated in the signal generator 210*c*, and a current in accordance with the data signal (data) flows in the pixel in response to the scan signal (scan), the data signal (data), the first power ELVDD, the second power ELVSS, the third power MOSVSS, and the initialization voltage VINIT. The power generator 220*c* receives the first power ELVDD generated in the power supply unit 300*c* and converts it into a negative voltage to generate the third power MOSVSS. Thereafter, the power generator 220*c* sends the third power MOSVSS to the display unit 100*c*.

The power supply unit 300*c* generates the first power ELVDD, the second power ELVSS, and the initialization voltage VINIT to send to the display unit 100*c*. The power supply unit 300*c* boosts input voltage Vin sent from the outside to generate the first power ELVDD, and inverts the input voltage Vin to generate the second power ELVSS.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device comprising:

a display unit for receiving a scan signal, a light emitting control signal, and a data signal, and enabling a current to flow from a first power supply to a second power supply, the current corresponding to the data signal, the display unit comprising a pixel comprising:

a switch;

a first capacitor having a first terminal and a second terminal, the first terminal coupled to a control terminal of the switch, the first capacitor adapted to receive the data signal through the switch and store the data signal and to stabilize the stored data signal utilizing a third power supply; and a second capacitor having a first terminal coupled to a first scan line, and a second terminal coupled to the first terminal of the first capacitor; and a driver comprising a signal generator for generating the data signal, the scan signal, and the light emitting control signal, and further comprising a power generator for generating a first power of the first power supply, a second power of the second power supply, and a third power of the third power supply, the third power applied to the second terminal of the first capacitor, wherein the second power and the third power are at a lower voltage than that of the first power.

2. The organic light emitting display device as claimed in claim 1, wherein the switch of the pixel comprises a first transistor having a source coupled to a first node, a drain coupled to a second node, and a gate coupled to a third node, and wherein the pixel further comprises:

an organic light emitting diode;

a second transistor having a source coupled to a data line, a drain coupled to the first node, and a gate coupled to the first scan line;

a third transistor having a source coupled to the second node, a drain coupled to the third node, and a gate coupled to the first scan line;

a fourth transistor having a source for receiving an initialization voltage, a drain coupled to the third node, and a gate coupled to a second scan line;

a fifth transistor having a source coupled to the first power supply, a drain coupled to the first node, and a gate coupled to a light emitting control line; and a sixth transistor having a source coupled to the second node, a drain coupled to the organic light emitting diode, and a gate coupled to the light emitting control line, wherein the first capacitor has the first terminal coupled to the third node, and the second terminal coupled to the third power supply.

3. The organic light emitting display device as claimed in claim 1, wherein the power generator is adapted to vary voltage of the second power.

4. An organic light emitting display device comprising:

a display unit for receiving a scan signal, a light emitting control signal, and a data signal, and enabling a current to flow from a first power supply to a second power supply, the current corresponding to the data signal, the display unit comprising a pixel comprising a switch and a first capacitor having a first terminal and a second terminal, the first terminal coupled to a control terminal of the switch, the first capacitor adapted to receive the data signal through the switch and store the data signal and to stabilize the stored data signal utilizing a third power supply; and a driver comprising a signal generator for generating the data signal, the scan signal, and the light emitting control signal, and further comprising a power generator for generating a first power of the first power supply, a second power of the second power supply, and a third power of the third power supply, the third power applied to the second terminal of the first capacitor, wherein the second power and the third power are at a lower voltage than that of the first power, and wherein the power generator comprises:

a voltage divider comprising a plurality of resistors coupled in series between a high-state voltage and a low-state voltage;

a selector for selecting and outputting a reference voltage from the voltage divider;

a charge pump for increasing an absolute value of the reference voltage output from the selector; and a regulator for receiving an output from the charge pump and outputting the third power.

5. An organic light emitting display device comprising:

a display unit for receiving a scan signal, a light emitting control signal, and a data signal, and enabling a current to flow from a first power supply to a second power supply, the current corresponding to the data signal, the display unit comprising a pixel comprising:

a switch;

a first capacitor having a first terminal and a second terminal, the first terminal coupled to a control terminal of the switch, the first capacitor adapted to receive the data signal through the switch and store the data signal, wherein the stored data signal is stabilized utilizing a third power supply; and a second capacitor having a first terminal coupled to a first scan line, and a second terminal coupled to the first terminal of the first capacitor;

a driver for generating the data signal, the scan signal, and the light emitting control signal; and a power generator for generating a first power of the first power supply, a second power of the second power supply, and a third power of the third power supply, the third power applied to the second terminal of the first capacitor, wherein the second power and the third power are at a lower voltage than that of the first power.

6. The organic light emitting display device as claimed in claim 5, wherein the switch of the pixel comprises a first transistor having a source coupled to a first node, a drain coupled to a second node, and a gate coupled to a third node, and wherein the pixel further comprises:

an organic light emitting diode;

a second transistor having a source coupled to a data line, a drain coupled to the first node, and a gate coupled to the first scan line;

a third transistor having a source coupled to the second node, a drain coupled to the third node, and a gate coupled to the first scan line;

a fourth transistor having a source for receiving an initialization voltage, a drain coupled to the third node, and a gate coupled to a second scan line;

a fifth transistor having a source coupled to the first power supply, a drain coupled to the first node, and a gate coupled to a light emitting control line; and a sixth transistor having a source coupled to the second node, a drain coupled to the organic light emitting diode, and a gate coupled to the light emitting control line, wherein the first capacitor has the first terminal coupled to the third node, and the second terminal coupled to the third power supply.

7. The organic light emitting display device as claimed in claim 5, wherein the power generator is adapted to vary voltage of the second power.

8. An organic light emitting display device comprising:

a display unit for receiving a scan signal, a light emitting control signal, and a data signal, and enabling a current to flow from a first power supply to a second power supply, the current corresponding to the data signal, the display unit comprising a pixel comprising a switch and a first capacitor having a first terminal and a second terminal, the first terminal coupled to a control terminal of the switch, the first capacitor adapted to receive the data signal through the switch and store the data signal, wherein the stored data signal is stabilized utilizing a third power supply;

a driver for generating the data signal, the scan signal, and the light emitting control signal;

and a power generator for generating a first power of the first power supply, a second power of the second power supply, and a third power of the third power supply, the third power applied to the second terminal of the first capacitor, wherein the second power and the third power are at a lower voltage than that of the first power, and wherein the power generator comprises:

a booster for amplifying an input voltage to generate the first power;

an inverter for inverting the input voltage to generate the second power; and a charge pump for inverting and amplifying the input voltage to generate the third power.

9. An organic light emitting display device comprising:

a display unit for receiving a scan signal, a light emitting control signal, and a data signal, and enabling a current to flow from a first power supply to a second power supply, the current corresponding to the data signal, the display unit comprising a pixel comprising:

a switch;

a first capacitor having a first terminal and a second terminal, the first terminal coupled to a control terminal of the switch, the first capacitor adapted to receive the data signal through the switch and store the data signal, wherein the stored data signal is stabilized utilizing a third power supply; and a second capacitor having a first terminal coupled to a first scan line, and a second terminal coupled to the first terminal of the first capacitor;

a driver for generating the data signal, the scan signal, the light emitting control signal, and a third power of the third power supply, the third power applied to the second terminal of the first capacitor; and a power generator for generating a first power of the first power supply and a second power of the second power supply, wherein the second power and the third power are at a lower voltage than that of the first power.

10. The organic light emitting display device as claimed in claim 9, wherein the driver is configured to receive the first power from the power generator and invert it to generate the third power.

11. The organic light emitting display device as claimed in claim 9, wherein the power generator is adapted to vary voltage of the second power.

12. An organic light emitting display device comprising:

a display unit for receiving a scan signal, a light emitting control signal, and a data signal, and enabling a current to flow from a first power supply to a second power supply, the current corresponding to the data signal, the display unit comprising a pixel comprising a switch and a first capacitor having a first terminal and a second terminal, the first terminal coupled to a control terminal of the switch, the first capacitor adapted to receive the data signal through the switch and store the data signal, wherein the stored data signal is stabilized utilizing a third power supply;

a driver for generating the data signal, the scan signal, the light emitting control signal, and a third power of the third power supply, the third power applied to the second terminal of the first capacitor; and a power generator for generating a first power of the first power supply and a second power of the second power supply, wherein the second power and the third power are at a lower voltage than that of the first power, wherein the switch of the pixel comprises a first transistor having a source coupled to a first node, a drain coupled to a second node, and a gate coupled to a third node, and wherein the pixel further comprises:

an organic light emitting diode;

a second transistor having a source coupled to a data line, a drain coupled to the first node, and a gate coupled to a first scan line;

a third transistor having a source coupled to the second node, a drain coupled to the third node, and a gate coupled to the first scan line;

a fourth transistor having a source for receiving an initialization voltage, a drain coupled to the third node, and a gate coupled to a second scan line;

a fifth transistor having a source coupled to the first power supply, a drain coupled to the first node, and a gate coupled to a light emitting control line;

a sixth transistor having a source coupled to the second node, a drain coupled to the organic light emitting diode, and a gate coupled to the light emitting control line; and a second capacitor having a first terminal coupled to the first scan line, and a second terminal coupled to the third node, wherein the first capacitor has the first terminal coupled to the third node, and the second terminal coupled to the third power supply.

13. An organic light emitting display device comprising:

a display unit for receiving a scan signal, a light emitting control signal, and a data signal, and enabling a current to flow from a first power supply to a second power supply, the current corresponding to the data signal; and a driver comprising a signal generator for generating the data signal, the scan signal, and the light emitting control signal, and further comprising a power generator for generating a first power of the first power supply, a second power of the second power supply, and a third power of a third power supply, wherein the second power and the third power are at a lower voltage level than that of the first power, and wherein the power generator comprises:

a voltage divider comprising a plurality of resistors coupled in series between a high-state voltage and a low-state voltage;

a selector for selecting and outputting a reference voltage from the voltage divider;

a charge pump for increasing an absolute value of the reference voltage output from the selector; and a regulator for receiving an output from the charge pump and outputting the third power.

* * * * *